United States Patent [19]

Courvoisier et al.

[11] Patent Number: 4,852,222

[45] Date of Patent: Aug. 1, 1989

[54] TENSIONING DEVICE FOR A SKI BOOT TIGHTENING CABLE

[75] Inventors: Guy Courvoisier, Celigny; Simon Arieh, Geneva, both of Switzerland

[73] Assignee: Lange International S.A., Switzerland

[21] Appl. No.: 190,151

[22] Filed: May 4, 1988

[30] Foreign Application Priority Data

Jul. 21, 1987 [CH] Switzerland ..... 2767/87

[51] Int. Cl.[4] ..... A43B 5/04

[52] U.S. Cl. ..... 24/68 SK; 24/71 SK; 36/50

[58] Field of Search ..... 24/68 SK, 69 SK, 70 SK; 36/50, 115, 117

[56] References Cited

U.S. PATENT DOCUMENTS

| | | | |
|---|---|---|---|
| 4,470,175 | 9/1984 | Chiarella | 24/71 SK |
| 4,654,985 | 4/1987 | Chalmers | 36/50 |
| 4,662,089 | 5/1987 | Pozzebon | 24/68 SK |
| 4,735,004 | 4/1988 | Dodge | 24/68 SK |
| 4,761,859 | 8/1988 | Calabrigo | 24/68 SK |
| 4,761,898 | 8/1988 | Courvoisier et al. | 24/68 SK |

FOREIGN PATENT DOCUMENTS

| | | | |
|---|---|---|---|
| 3013953 | 10/1981 | Fed. Rep. of Germany | 24/69 SK |
| 0230063 | 7/1987 | Fed. Rep. of Germany | . |

*Primary Examiner*—Victor N. Sakran

*Attorney, Agent, or Firm*—Kane, Dalsimer, Sullivan, Kurucz, Levy, Eisele and Richard

[57] ABSTRACT

The device comprises a base (10) on which is articulated a tension lever (9) acting on cables (6, 7). These cables are attached to a member (16) movable between two positions, namely a tightening position and a relaxation position, and mounted for sliding on the tensioning lever (9). Said movable member is displaceable by means of an auxiliary lever (11) mounted on the tensioning lever (9).

5 Claims, 6 Drawing Sheets

TENSIONING DEVICE FOR A SKI BOOT TIGHTENING CABLE

FIELD OF THE INVENTION

The present invention relates to a tensioning device for a ski boot tightening cable, said device comprising a base intended to be fixed to the boot and carrying a tensioning lever articulated on the base and having an anchorage for at least one cable.

PRIOR ART

A device of this kind is known, for example, from European patent application No. 0,230,063. When a device of this kind is mounted on the side of the boot, as described in the aforesaid European patent application, the tensioning lever is particularly cumbersome in the open position because it opens out laterally on the side of the boot and the skier, having firmly tightened his boot to ensure good skiing during the descent, generally feels a need to relax the tightening of his boots while waiting in line for a ski lift. For this purpose he must raise the tensioning levers, which then open out laterally and strike against or get caught up in the boots of neighbouring skiers. Such incidents may cause a fall.

The present invention seeks to enable the tightening of boots to be relaxed without raising the tensioning levers, that is to say without "unbuckling" the boots.

SUMMARY OF THE INVENTION

To this end the tensioning device according to the invention is characterized by the fact that the cable anchorage forms part of a member adapted to move between two positions, namely a tightening position and a relaxation position, and mounted for longitudinal sliding on the tensioning lever, and that the device is provided with an auxiliary lever associated with said movable member for the purpose of moving the latter.

In one embodiment the movable member consists of a slider operated by an eccentric fastened to the auxiliary lever mounted for rotation on the tensioning lever. In order to relax the tightening tension, the tensioning lever is pivoted substantially parallel to the boot, in such a manner that it does not move away from the latter. Relaxing the cables to the extent of 10 millimeters is generally sufficient to restore acceptable comfort.

In another embodiment the auxiliary lever is articulated on the slider, parallel to the articulation axis of the tensioning lever, and has an eccentric portion which comes to bear against the end of the tensioning lever. In this embodiment the auxiliary lever moves away from the boot in the relaxation position, but if the tensioning lever is slightly bent and its end is situated at the rear of the boot, and if the auxiliary lever is relatively short, this projection is not troublesome.

BRIEF DESCRIPTION OF THE DRAWINGS

The accompanying drawings illustrate by way of example two embodiments of the invention.

DESCRIPTION OF THE PREFERRED EMBODIMENTS

Figure 1:
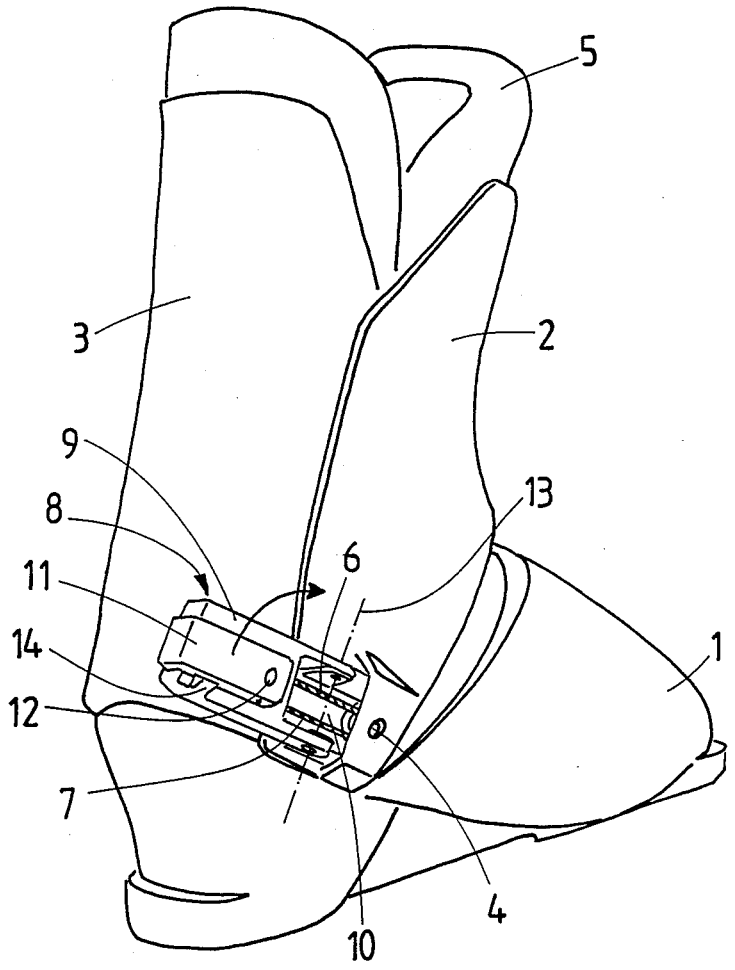
FIG. 1 shows schematically a boot equipped with a tensioning device according to a first embodiment, with the auxiliary lever in the tightening position.

FIG. 1 shows a shell type ski boot comprising a shell bottom 1 and an upper composed of a front half-upper 2 and a rear half-upper 3, both half-uppers being pivoted on the shell bottom 1 about a pin 4. This boot is therefore of the rear entry type and also comprises an inner sock 5. The two parts 2 and 3 of the upper are closed by a buckle (not shown). The foot is held by a cable device, for example of the kind described in patent application EP No. 0,230,063, and the two cables 6 and 7 are tensioned by means of a tensioning device 8 mounted on the side of the boot, on the front half-upper 2.

Figure 2:
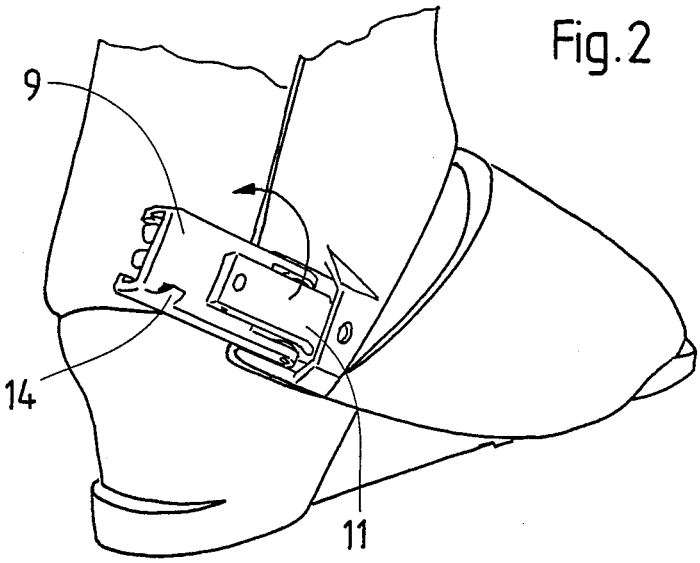
FIG. 2 shows part of the same boot with the auxiliary lever in the relaxation position.

The tensioning device is composed of a tensioning lever 9 pivoted on a U-shaped base fixed on the half-upper 2. On the tensioning lever 9 an auxiliary relaxation lever 11 is mounted on a pin 12 substantially at right angles to the plane of the cables 6 and 7 and to the boot. In the tightening position shown in FIG. 1 the auxiliary lever 11 extends parallel to the tensioning lever 9 and in the same direction as the latter in relation to the pivot axis 13 of the tensioning lever. In order to pass to the relaxation position, the auxiliary lever 11 must be pivoted about its axis 12 in the direction of the arrow. The auxiliary lever then assumes the position shown in FIG. 2. In order to return to the tightening position, the auxiliary lever 11 is brought back to the position shown in FIG. 1 by turning it in the other direction (arrow in FIG. 2). The rotation of the auxiliary lever 11 is limited by a stop 14 formed on the tensioning lever 9.

Figure 3:
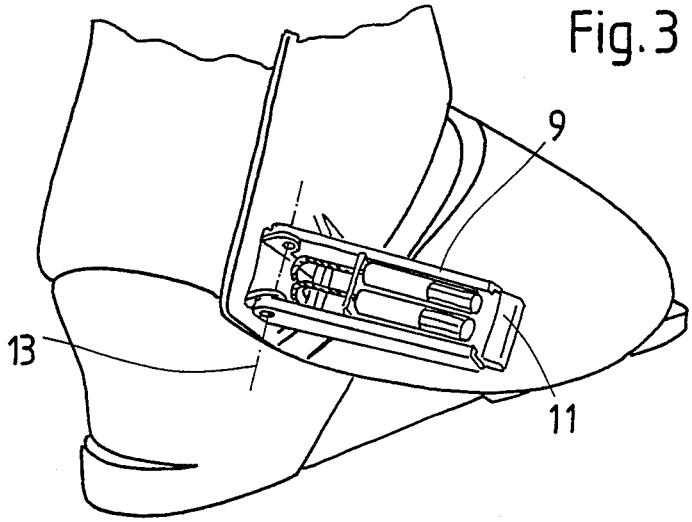
FIG. 3 shows part of the same boot with the tensioning lever open.
Figure 4:
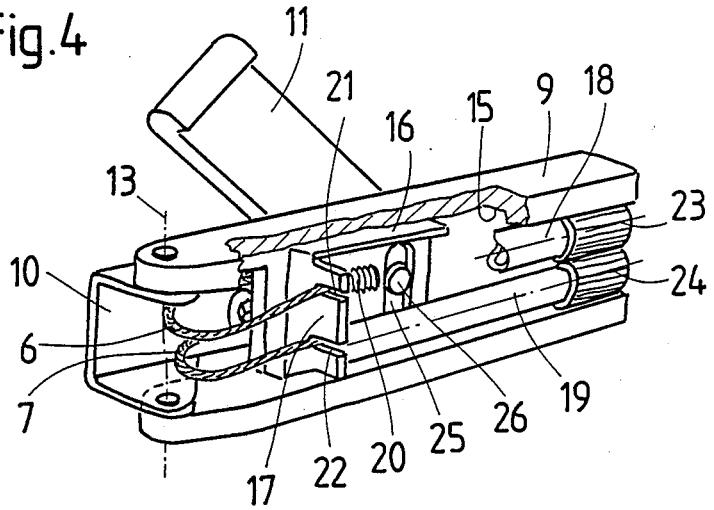
FIG. 4 shows the tensioning device by itself, in the open position and with the auxiliary lever in an intermediate position, with parts broken away to show the construction of the device.
Figure 5:
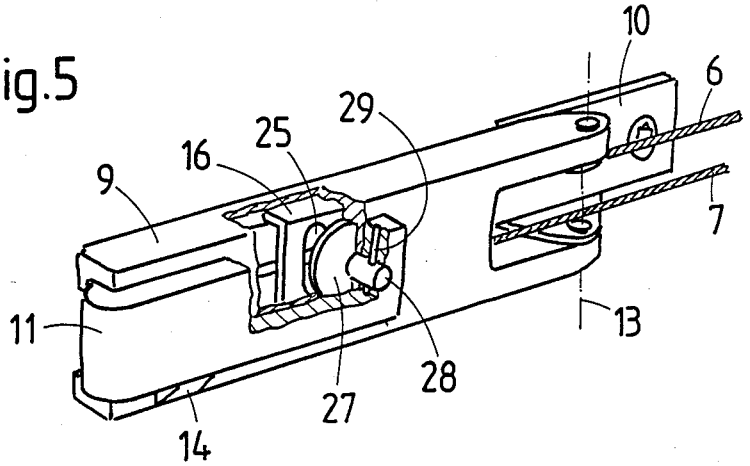
FIG. 5 shows the same tensioning device in the closed position, with the auxiliary lever in the tightening position, parts being broken away to show the construction of the device.

FIGS. 3 and 4 show the tensioning lever 9 in the open position, particularly for putting on or taking off the boot. The tensioning lever 9 has over its greater part a T-shaped internal profile 15 forming a slide guide for a slider 16 having a projecting portion 17 forming a support and anchorage stop for the heads of the cables 6 and 7. These cable heads consist of two internally threaded tubes 18 and 19 containing a threaded stud 20 fixed to the cable and screwed into the internally threaded tube. The cables 6 and 7 pass through the support portion 17 of the slider by way of two slots 21 and 22 enabling the cable heads to be fastened to the slider 16. The tension of each of the cables is adjusted by turning the tubes 18 and 19, which for this purpose are provided with a knurled or milled end 23 and 24 respectively. The tubes 18 and 19 could also be mounted on swivel joints as in patent application EP No. 0,230,063.

Figure 6:
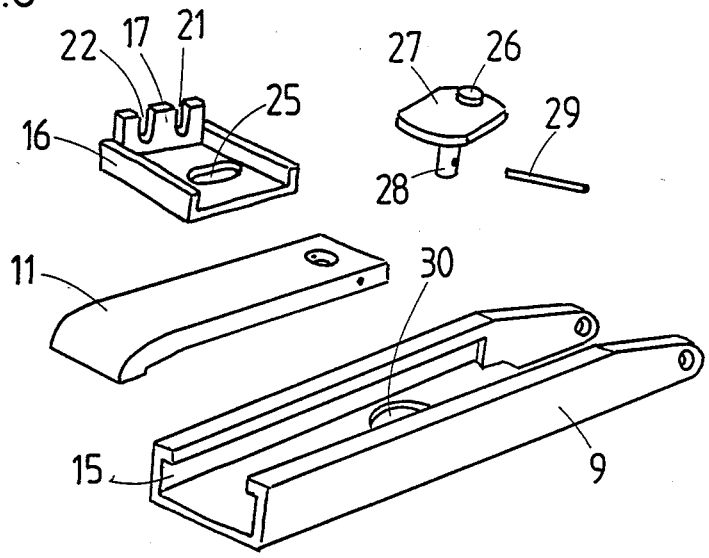
FIG. 6 shows separately the essential components of the device.

The slider 16 has a transverse slot or hole 25 in which is engaged the crank pin 26 of an eccentric 27 whose shaft 28, which passes through the lever 9, is fixed to the auxiliary relaxation lever 11 by means of a pin 29. The eccentric 27 is received in a hollow 30 in the tensioning lever 9 (FIG. 6).

Figure 7:
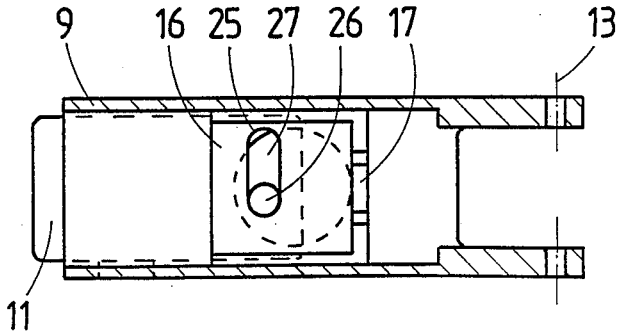
FIG. 7 is a back view of the tensioning lever, without the base or the cable, in the tightening position.
Figure 8:
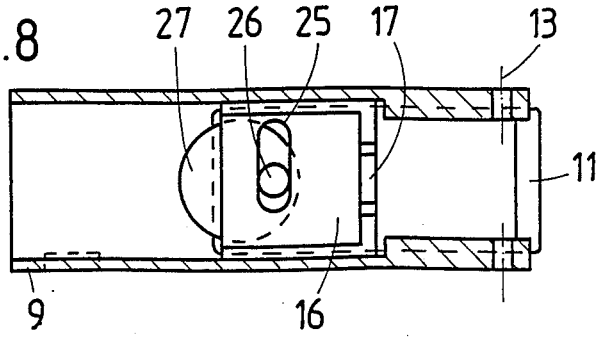
FIG. 8 is a view similar to FIG. 7, with the auxiliary lever in the relaxation position.

FIG. 7 shows the position of the slider 16 and of the crank pin 26 in the tightening position, while FIG. 8 shows the same slider 16 in the relaxation position. The eccentricity radius will preferably be between 5 and 8 millimeters.

The slider 16 may be operated in a different manner from that illustrated in FIGS. 1 to 8. FIGS. 9 to 12 illustrate by way of example another manner of operating the slider. In FIGS. 9 to 12 the components similar to those in the first embodiment have been given the same references with the addition of a prime, in order to avoid repetition of the description of these components. The relaxation lever is here composed of a lever 31 pivoted on the slider 16' about a pin 32 parallel to the pivot axis 13' of the tensioning lever 9', between two arms 33 and 34 extending the slider 16' beyond the tensioning lever 9'. Around the pin 32 the auxiliary relaxation lever 31 has two eccentric portions 35 and 36 which come to bear against the end 37 of the tensioning lever 9'.

Figure 9:
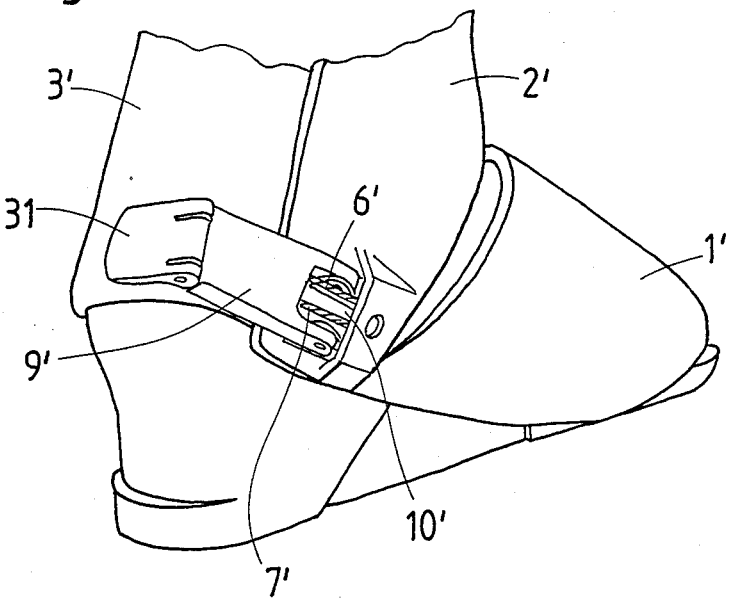
FIG. 9 shows part of a boot equipped with a tensioning device according to a second embodiment, shown in the tightened position.
Figure 10:
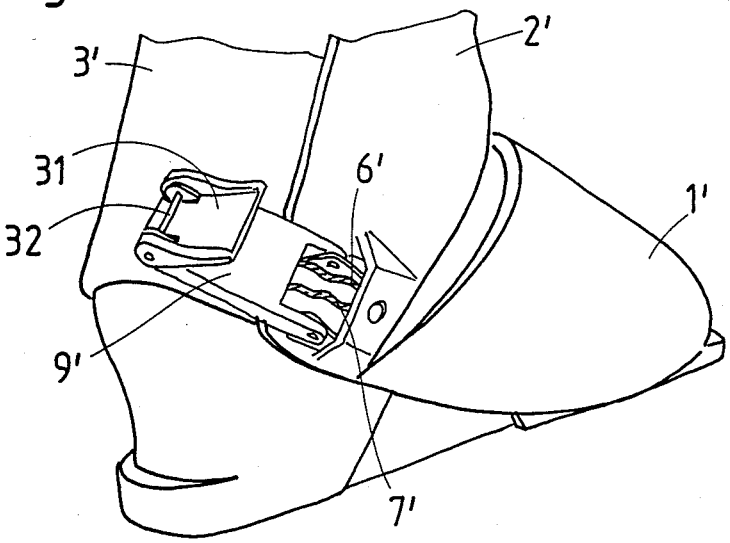
FIG. 10 is a view similar to FIG. 9, showing the auxiliary lever in the relaxation position.
Figure 11:
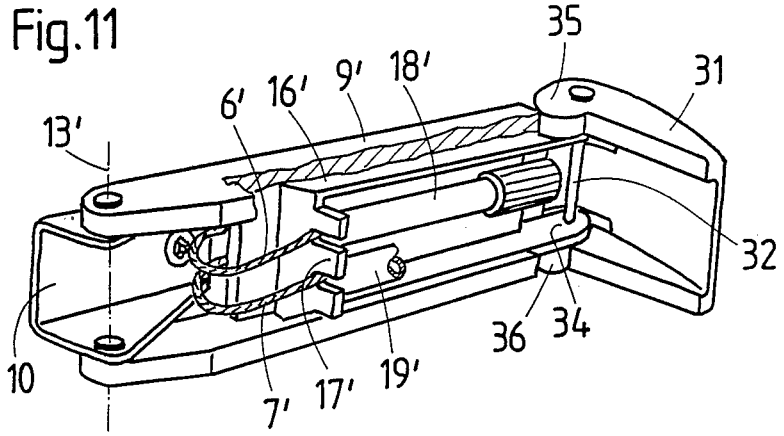
FIG. 11 shows the same tensioning device in the open position, with the auxiliary lever in the tightening position.
Figure 12:
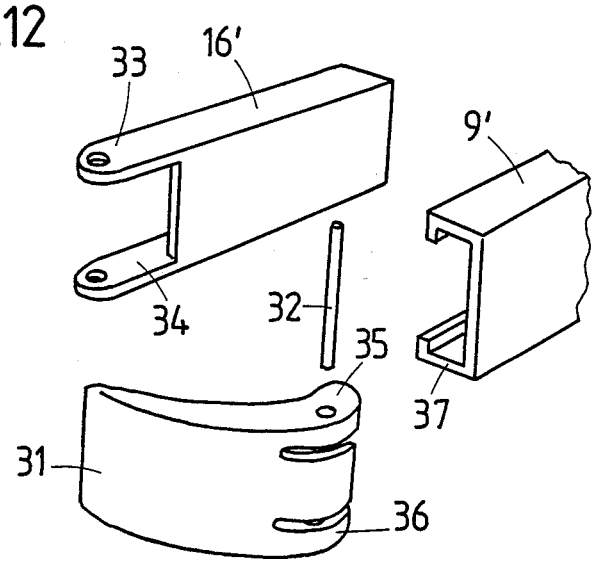
FIG. 12 shows separately the essential components of the device shown in FIG. 11.

FIG. 9 shows the auxiliary lever 31 in the tightening position. In this position the auxiliary lever 31 forms an elbow with the tensioning lever 9' and matches the rounded shape of the rear half-upper 3'. In order to relax the tension it is sufficient to raise the auxiliary lever 31 and to pivot it towards the front of the boot, as shown in FIG. 10. In this position the auxiliary lever 31 projects laterally, relative to the boot, only to a very slight extent. The boot can be retightened by the auxiliary lever 31 without first opening the tensioning lever 9'. In the position shown in FIG. 10 the tensioning lever 9' can moreover be very easily opened. FIG. 11 shows the tensioning lever 9' in the open position and the auxiliary lever 31 in the closed position, that is to say in the tightening position.

As an alternative, the auxiliary relaxation lever 31 could be pivoted on the tensioning lever 9' and connected to the slider 168 by a cable or connecting rod. The auxiliary lever could for example be U-shaped and pivot about the same axis 13 as the tensioning lever.

Furthermore, the ends of the cables could be anchored directly in the slider 16' and the tension could be adjusted through the displacement of the slider 16' and of a part of the tensioning lever 9', for example by means of a screw driving a stop corresponding to the end 37.

The tensioning device according to the invention can be used on any type of boot, particularly on a boot of the type described in European patent application No. 0,229,405 and in U.S. Pat. No. 4,654,985.

We claim:

1. A tensioning device for a ski boot tightening cable, comprising a base intended to be fixed to the boot and carrying a tensioning lever articulated on the base and having an anchorage for at least one cable, wherein the anchorage forms part of a member adapted to move between two positions, namely a tightening position and a relaxation position, and mounted for longitudinal sliding on the tensioning lever, said device being provided with an auxiliary lever associated with said movable member for the purpose of moving the latter.

2. A device as claimed in claim 1, wherein said movable member consists of a slider having a transverse slot which is parallel to the pivot axis of the tensioning lever and in which is engaged the crank pin of an eccentric fastened to the auxiliary lever mounted for rotation on the tensioning lever.

3. A device as claimed in claim 1, wherein the movable member consists of a slider extending beyond the end of the tensioning lever, and wherein the auxiliary lever is pivoted to this projecting end of said slider, about an axis transversal to the slider, said auxiliary lever bearing by means of an eccentric portion against the end of the tensioning lever.

4. A device as claimed in claim 1, wherein the auxiliary lever is transversely pivoted on the tensioning lever and is connected by a connecting rod or cable to said movable member.

5. A device as claimed in one of claims 1 to 4, wherein the anchorage is a support for a cable head consisting of an internally threaded tube in which is mounted a threaded stud fixed to the cable.

* * * * *